US006068363A

United States Patent [19]

Saito

[11] Patent Number: 6,068,363

[45] Date of Patent: May 30, 2000

[54] RECORDING HEAD AND APPARATUS EMPLOYING MULTIPLE TEMPERATURE SENSORS TO EFFECT TEMPERATURE CONTROL

[75] Inventor: Asao Saito, Yokohama, Japan

[73] Assignee: Canon Kabushiki Kaisha, Tokyo, Japan

[21] Appl. No.: 08/887,634

[22] Filed: Jul. 3, 1997

[30] Foreign Application Priority Data

Jul. 4, 1996 [JP] Japan ..... 8-174841

[51] Int. Cl.[7] ..... B41J 2/05

[52] U.S. Cl. ..... 347/17; 347/42

[58] Field of Search ..... 347/14, 17, 42, 347/191, 192, 194; 374/110, 189, 204

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,704,618 | 11/1987 | Gotoh et al. | 346/76 P |
| 4,723,129 | 2/1988 | Endo et al. | 346/1.1 |
| 4,740,796 | 4/1988 | Endo et al. | 346/1.1 |
| 5,175,565 | 12/1992 | Ishinaga et al. | 346/140 R |
| 5,760,797 | 6/1998 | Koizumi et al. | 374/14 |

FOREIGN PATENT DOCUMENTS

| | | |
|---|---|---|
| 0 419 178 | 3/1991 | European Pat. Off. . |
| 0 709 213 | 5/1996 | European Pat. Off. . |
| 60-076358 | 4/1985 | Japan . |
| 62-162565 | 7/1987 | Japan . |
| 62-279976 | 12/1987 | Japan . |

*Primary Examiner*—Joan Pendegrass
*Attorney, Agent, or Firm*—Fitzpatrick, Cella, Harper & Scinto

[57] ABSTRACT

The object of the present invention is to control temperature sensors and heaters provided to a plurality of elemental substrates to appropriately perform temperature control for each of the elemental substrates, wherein a multiplexer 13 is connected to temperature sensors provided to each of a plurality of elemental substrates 14, and the detection signals of these temperature sensors are selectively output from terminals 10 of the head 20 via the multiplexer 13.

20 Claims, 10 Drawing Sheets

RECORDING HEAD AND APPARATUS EMPLOYING MULTIPLE TEMPERATURE SENSORS TO EFFECT TEMPERATURE CONTROL

BACKGROUND OF THE INVENTION

1. Field of the Invention

The present invention relates to a recording head and a recording apparatus. More specifically, the present invention relates to a recording head and a recording apparatus wherein the recording head comprises a plurality of temperature sensors and recording units having temperature adjusting heaters.

Note that the term "record" used relating to the present invention not only describes meaningful images such as characters or shapes to be provided to recording media, but the description thereof also encompasses providing to the same of meaningless images, such as patterns.

Also, note that the present invention is applicable to various apparatuses, such as printers, photocopiers, facsimile apparatuses having communication systems, word processors having printer devices, and the like, which perform recording on recording media such as paper, thread, fiber, cloth, leather, metal, plastic, wood, glass, ceramics, and the like, and that the present invention is further applicable to industrial recording apparatuses which are compounded combinations of various types of processing apparatuses.

2. Description of the Related Art

Generally, ink-jet heads used for ink-jet printing apparatuses are such wherein, for example, a number of nozzles corresponding to a maximum of around 128 bits are provided, which are scanned in a direction orthogonal to the direction of feeding of the recording paper serving as a printing medium, thus forming an image. It has also become possible to further improve the through-put of printing by means of further increasing the number of nozzles and making the head lengthy in configuration. However, making the head lengthy requires a total number of nozzles in the thousands, which has been a problem as compared to known serial printer heads, in that the manufacturing cost is increased, as well.

Methods have been proposed to deal with such problems, wherein, e.g., a plurality of elemental substrates are arrayed with good precision, these elemental substrates being comprised of electro-thermal converting devices or functional devices for serving as recording devices for causing ejecting of ink. Such an arrangement enables usage of elemental substrates with built-in electro-thermal converting devices or functional devices as line heads. The advantages of employing elemental substrates with built-in electro-thermal converting devices or functional devices are: reduced costs due to simplification in mounting, increase in yield, and further, enabling usage of temperature sensors utilizing semiconductors.

With such known line heads wherein elemental substrates are arrayed as described above, the increase in the number of terminals for connectors provided to the purpose of electric connection between the arrayed elemental substrates and portions other than the head has been a problem, and this along with other problems has made usage of temperature sensors on all of the arrayed elemental substrates difficult.

FIG. 14 and FIG. 15 illustrate the construction of a line head according to the related art. FIG. 14 is a perspective view of the overall configuration of a line head, wherein the head 30 is comprised of a metal base 1 such as aluminum, upon which are formed a plurality of elemental substrates 14 in a row array, upon each which elemental substrates are formed an electro-thermal conversion device (not shown), a temperature sensor, a heat-retaining heater, and the like. Further provided on the substrate 14 is an ink channel comprising ink-ejecting nozzles, and a top plate 3 forming an ink liquid chamber for supplying ink to be ejected. Orifices 42 from which ink is discharged are opened on the orifice plate surface of the front side of the top plate 3. Springs 43 and a spring fixing member 44 are provided in order to fix this top plate 3. The ink is supplied to the ink liquid chamber of the top plate 3, by means of the ink channel member 5, via a connector 45 connected to the recording apparatus main unit. Also, a print substrate 2 is provided upon the base 1, with the electrodes of the print substrate 2 being electrically connected to the wiring of the substrate 14 by means of wire bonding. Further provided to the side surface of the print substrate 2 are connecting electrodes 10 for performing electrical connection with the recording apparatus main unit (hereafter referred to simply as "main unit").

FIG. 15 is a schematic block constructional diagram of such a head 30. In the example illustrated in this Figure, eight elemental substrates 14 are provided, with four of these elemental substrates 14 further comprising temperature sensors of which output is obtained therefrom. For example, in the case of using a line head comprised of nozzles arrayed the full width of A4 size recording paper as the head 30, approximately 3,000 or more become necessary, so that the total number of elemental substrates 14 each provided with 128 electro-thermal converting devices required for such an arrangement is approximately 25. Accordingly, the number of terminals required to extend the temperature sensor terminals and heat-retaining heater terminals from all of these is 80 or so, and it has been quite difficult to provided such a number of terminals on a head.

With the above-described line head 30 comprised of an array of a plurality of elemental substrates 14, each substrate 14 is die-bonded onto the base 1 formed of aluminum or the like, using thermal-conductive adhesive agent. However, each of the elemental substrates 14 a thermally insulated. Accordingly, irregularities in the position of each of the elemental substrates 14 or the thickness of the adhesive agent applied to the base for fixing the substrate into the base may cause different thermal properties among each of the elemental substrates 14. Hence, it has been known that the temperature change may not be correctly detected depending on the substrate 14, if each of the temperature sensors of all of the elemental substrates 14 cannot be used for highly precise head temperature control.

Also, when a user creates a document, it is generally true that the position of characters, diagrams, and the like are often fixed with respect to the location thereof. Further, in the case of line heads, the printing region of each of the nozzles is fixed, so the change in image duty distribution is small compared to that with serial heads according to the scanning method, thus increasing irregularity in rising of temperature. With such line heads temperature control of the elemental substrates 14 can be effectively performed with high precision by means of increasing the number of times of reading the output of the temperature sensors, but depending on the capabilities of the CPU used or the load of the processing contents, sufficient timing may not be able to be obtained necessary for reading the output of the temperature sensors. Moreover, since there is the possibility that the thermal properties of each of the elemental substrates 14 may differ due to the abovedescribed reasons, it is preferable that each of the heat-retaining heaters provided to each of the elemental substrates 14 be independently controlled in order to perform temperature control in an effective manner, however, since there is a limit to the number of terminals for connectors as described above, realizing such an arrangement has been quite difficult.

SUMMARY OF THE INVENTION

Accordingly, it is an object of the present invention to provide a recording head and a recording apparatus in which temperature sensors and heaters provided to a plurality of elemental substrates can be controlled so that temperature control of each substrate can be appropriately performed, without increasing the number of terminals for external connection.

According to a first aspect of the recording head according to the present invention, a recording head comprises: a plurality of recording units further comprising a recording device for performing recording on a recording medium and a temperature detecting sensor; and a selection circuit for selectively outputting from the head the detection signals of the aforementioned sensors of each of the aforementioned plurality of recording units.

Also, according to a second aspect of the recording head according to the present invention, a recording head comprises: a plurality of recording units further comprising a recording device for performing recording on a recording medium and a temperature adjusting heater; and a selection circuit for selectively driving the aforementioned temperature adjusting heaters provided to each of the aforementioned plurality of recording units.

Further, a recording apparatus according to the present invention comprises: one of the above recording heads; and transporting means for transporting the recording medium.

Thus, according to the present invention, temperature detection of each substrate is enabled without increasing the number of terminals, by means of enabling selective output of detection signals of the temperature sensors of each of the plurality of elemental substrates as necessary from shared terminals. Also, temperature control can be performed at precision higher than that of the known related art, by means of selectively operating the heaters provided to each of the plurality of elemental substrates as necessary. Consequently, higher image quality, prevention of density irregularities, and improvement of operation reliability can be achieved as compared to using known line heads.

DESCRIPTION OF THE PREFERRED EMBODIMENTS

First Embodiment

Figure 1:
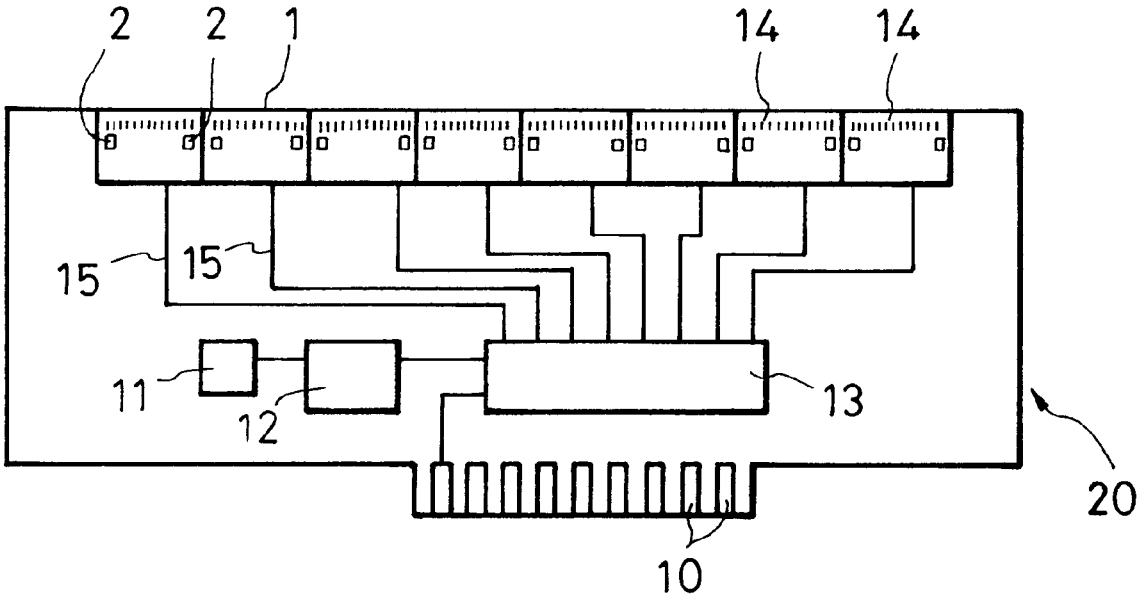
FIG. 1 is a schematic block constructional diagram of the recording head according to the first embodiment of the present invention.
Figure 15:
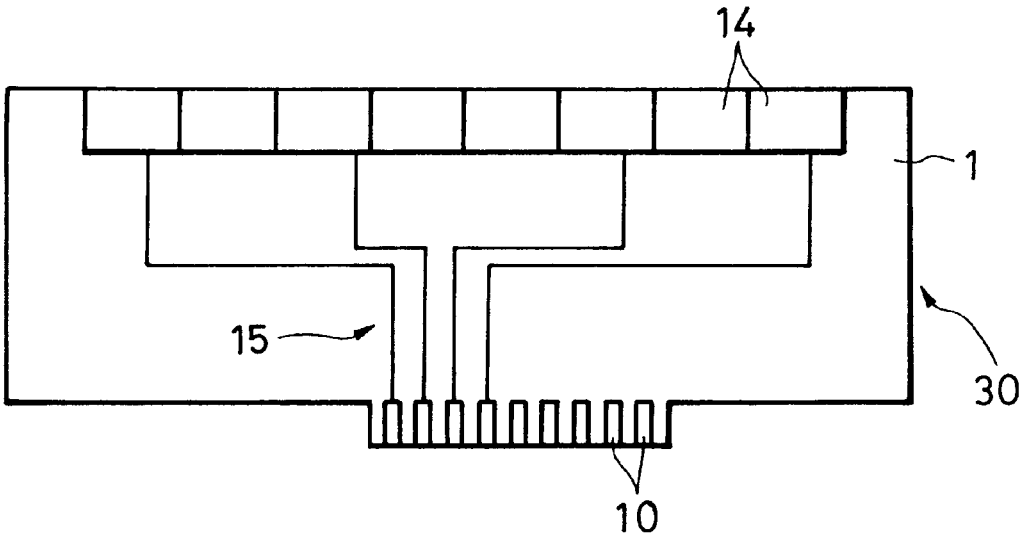
FIG. 15 is a schematic block constructional diagram of a known recording head.

FIG. 1 is a schematic block constructional diagram of the head 20 according to the first embodiment of the present invention, wherein the parts thereof which are the same as those shown in the example illustrated in FIG. 15 are denoted by the same numerals with the description thereof being omitted. The substrate 14 serving as a recording unit is provided with an electro-thermal converting device 1 for ejecting ink, a temperature sensor 2, and a functional device (not shown). The output terminal of the temperature sensor provided to the substrate 14 is extended by means of the wiring 15, the output of which is input into an analog multiplexer 13. The output of the temperature sensor selected by the analog multiplexer 13 serving as temperature sensor output selection means is extracted from the head 20 by means of output terminals 10 provided for comprising electrical connection between the head 20 and portions other than the head 20. The output of the temperature sensor for each of the elemental substrates 14 is extracted in a uniform manner by means of using decode signals from the counter 12, thus enabling temperature control of the head 20 based on an averaged value of the temperature of each of the elemental substrates 14.

Figure 2:
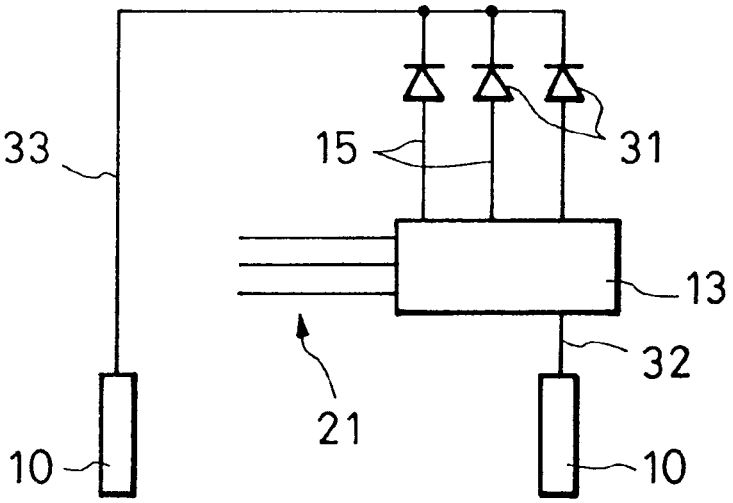
FIG. 2 is a connection circuit diagram of the principal components of the recording head according to the first embodiment of the present invention.

FIG. 2 illustrates a connection example of the temperature sensor 31 and multiplexer 13. In the present embodiment, diodes formed within the substrate 14 are used as the temperature sensor 31, employing the properties thereof wherein voltage effect in the direction of easy flow has temperature properties. The cathode electrode of these diodes is made to serve as a common electrode 33, the anode electrodes thereof are connected to the analog multiplexer 13, and using the selected signal 21 input from the analog multiplexer 13, these anode electrodes are selectively connected with the external recording apparatus main unit via an extracting electrode 32. The recording apparatus main unit detects temperature by means of reading the falling voltage in the direction of easy flow of the diode selected by the analog multiplexer 13.

Figure 3:
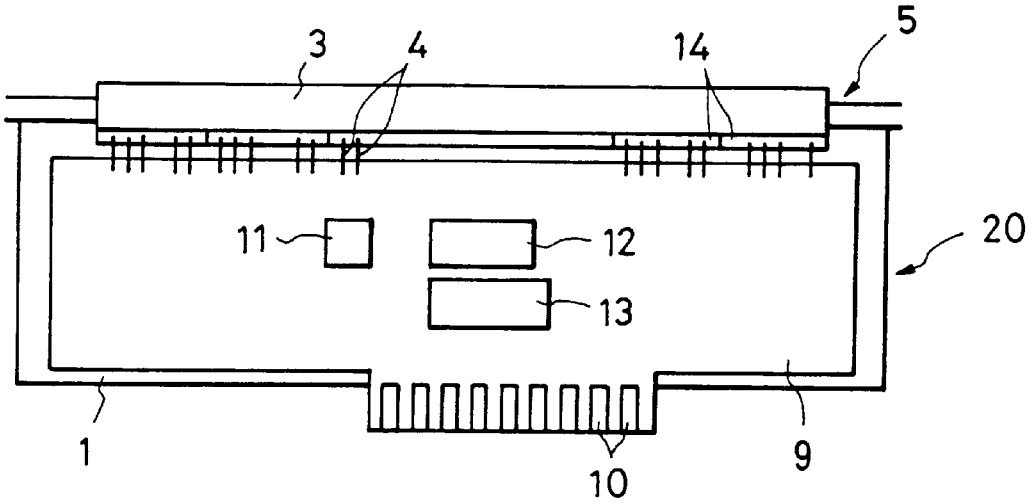
FIG. 3 is a plan view of the recording head according to the first embodiment of the present invention.
Figure 4:
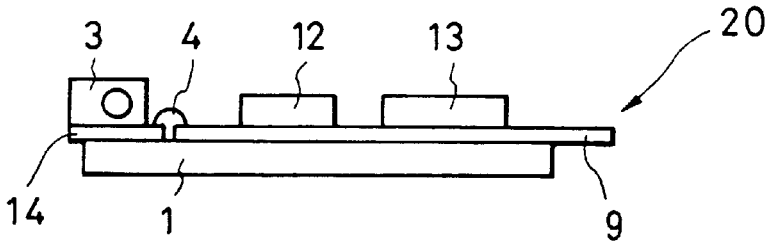
FIG. 4 is a side view of the recording head according to the first embodiment of the present invention.
Figure 14:
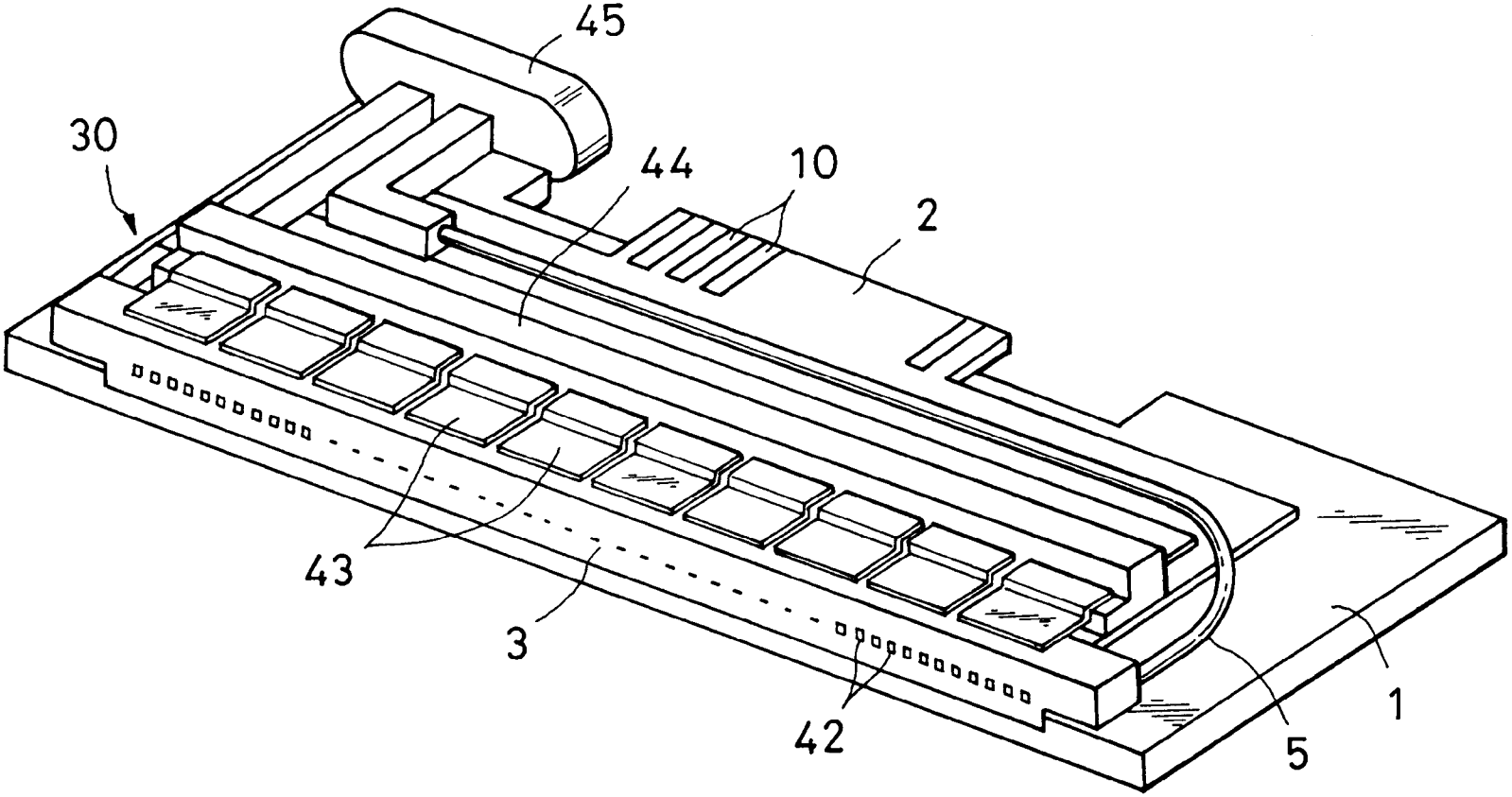
FIG. 14 is a perspective view illustrating an example of a known recording head.

FIG. 3 and FIG. 4 are assembly diagrams of the head 20 formed in a lengthy configuration. The elemental substrates 14 are die-bonded onto the base 1 formed of a metal such as aluminum or the like, using thermal-conductive adhesive agent. Also, a print substrate 9 for extracting electrical signals from the head 20 to portions other than the head 20 is provided upon the base 1. The electrical connection between the print substrate 9 and the substrate 14 is carried out by means of wire bonding using bonding wire 4. Further provided to the print substrate 9 are ICs comprising an analog multiplexer 13, a counter 12, and so forth, as well as connector terminals 10 for performing electrical connection with portions other than the head 20. Provided to the elemental substrates 14 are top plates 3 (grooved members) further comprising ink channels and ink chambers used for discharging ink. Ink is supplied to the top plates 3 from portions other than the head by means of the channel member 5 (see FIG. 14).

Figure 5:
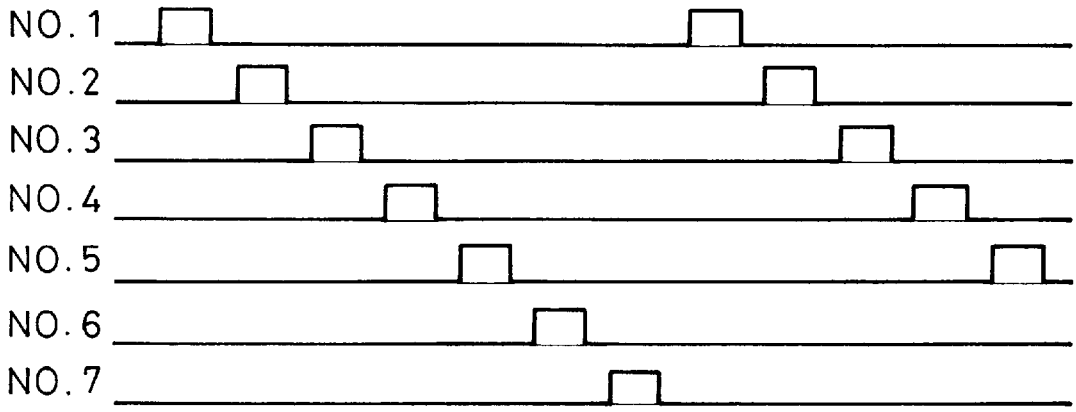
FIG. 5 is a diagram for describing the detection timing of the temperature sensors of the recording head according to the first embodiment of the present invention.

FIG. 5 illustrates the detection timing of the temperature sensors 31 for each of the elemental substrates 14, for an arrangement where a line head 20 is constructed using seven elemental substrates 14. In the Figure, rotational selection is made of each the temperature sensors 31 No. 1 through No. 7 on the elemental substrates 14 according to output of the counter 12, thus detecting the temperature of the corresponding substrate 14.

As described above, with a line head 20 of arrayed elemental substrates 14, each of the elemental substrates 14 are separated thermally, increasing the irregularity in temperature increase between each. In such a case, it is effective to read all of the temperature sensors 31, in order to perform temperature control with good precision. According to the present embodiment, the detection temperatures of the temperature sensors 31 of all of the elemental substrates 14 can be read, without increasing the number of connection terminals connecting the head 20 to portions other than the head 20, thus enabling maintaining of necessary temperature detection precision.

Second Embodiment

Figure 6:
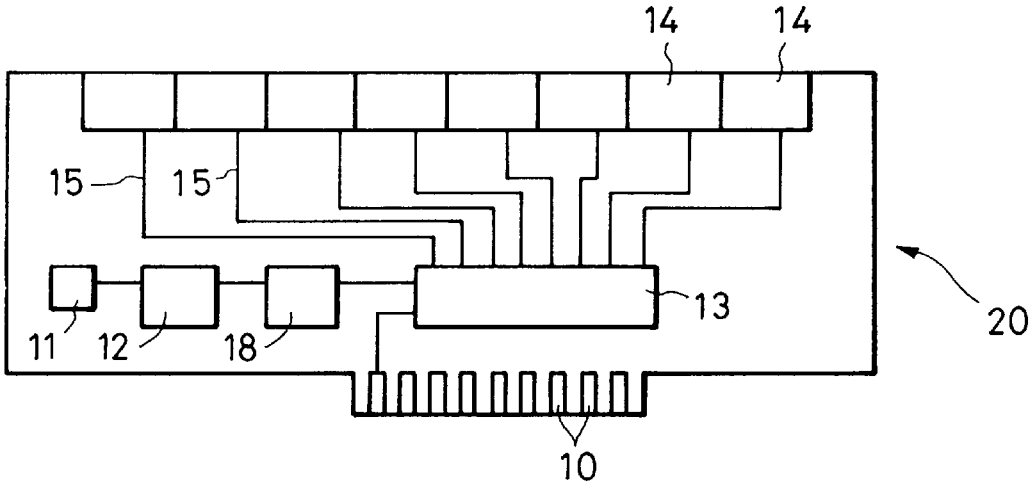
FIG. 6 is a schematic block constructional diagram of the recording head according to the second embodiment of the present invention.

FIG. 6 is a schematic block constructional diagram of the head 20 according to the second embodiment of the present invention. The substrate 14 serving as a recording unit is provided integrally with an electro-thermal converting device, a temperature sensor, and a functioning device. The output terminal of the temperature sensor provided to the substrate 14 is extended by means of the wiring 15, the output of which is input into an analog multiplexer 13. A clock signal from an oscillator 11 is input to a counter 12, thus generating address signals for a memory 18. The memory 18 is provided beforehand with selection signals of the analog multiplexer 13 which have been weighted according to each of the input terminals of the analog multiplexer 13, and the selected signals are output to the analog multiplexer 13 according to the address signal input to the memory 18 from the counter 12. The output of the temperature sensor selected by the analog multiplexer 13 serving as the selection means for selecting the output of the temperature sensors is extracted by a connector terminal 10 provided for performing electrical connection with portions other than the head 20.

Now, the weighting data set in the memory 18 is temperature sensor selection data corresponding to temperature sensor reference times (the number of times that reading has been performed for temperature sensor output) according to the temperature properties of each of the elemental substrates 14. The temperature sensor output from the substrate 14 is extracted in a weighted and selected manner, by means of using the selection signal of the memory 18, so that temperature control of the head 20 can be performed based on each uniquely weighted temperature sensor output, as necessary.

Incidentally, as described above, with a line head 20 of arrayed elemental substrates 14, each of the elemental substrates 14 are separated thermally, increasing the irregularity in temperature increase between each. Further, in the case of line heads, the change in image duty distribution for each nozzle is small compared to that with serial heads according to the scanning method, thus increasing irregularity in rising of temperature. In such a case, it is effective to increase the number of times of reading the temperature sensors, in order to perform temperature control of the portions with marked rising in temperature with good precision. However, depending on the capabilities of the CPU used or the load of the processing contents, sufficient timing may not be able to be obtained necessary for the number of times of reading the output of the temperature sensors. In such cases, precision of temperature detection can be maintained without lowering the overall processing capabilities, by means of making the number of times that the necessary portions are read to be greater compared to that of the other portions.

Figure 7:
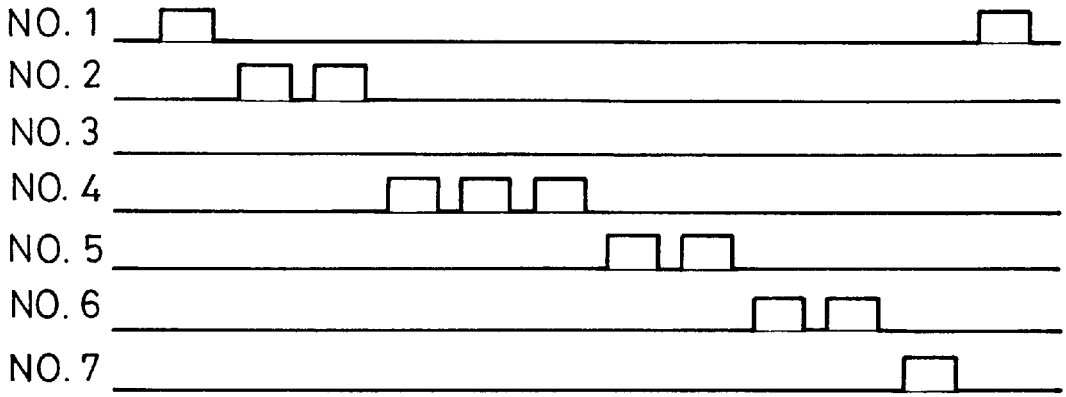
FIG. 7 is a diagram for describing the detection timing of the temperature sensors of the recording head according to the second embodiment of the present invention.

According to the present embodiment, precision of temperature detection can be maintained without lowering the overall processing capabilities, by means of the following arrangement: The printing duty is calculated beforehand on the side of the recording apparatus main unit based on the image data, thus predicting the substrate 14 of the block which will take on heavy duty. At the same time, detection temperature reading from a desired substrate 14 is selected, thus increasing the number of times that detection temperature is read in regard to the portion of the substrate 14 which particularly requires temperature detection, as compared with the number of times that detection temperature is read relating other portions. FIG. 7 shows an applied example of the present embodiment, illustrating the detection timing of the temperature sensors of each of the seven elemental substrates 14. In this example, No. 1 and 7 are detected once, Nos. 2, 3, 5, and 6 are detected twice, and No. 4 is detected thrice, thus comprising one sequence. Such an arrangement allows for increased temperature detection precision near the center of the head 20, by means of making the number of times of temperature sensor detection of the substrate 14 which is situated at the center to be more than that of temperature sensor detection of the elemental substrates 14 which are situated on the far edges of the head 20.

Further, storing series of such detection sequence data in memory, and selecting detection sequences for the printing conditions from the main unit according to the operation mode enables selecting of detecting sequences according to the printing mode (various types of printing, etc.), thus allowing temperature detection at even higher precision.

Third Embodiment

Figure 8:
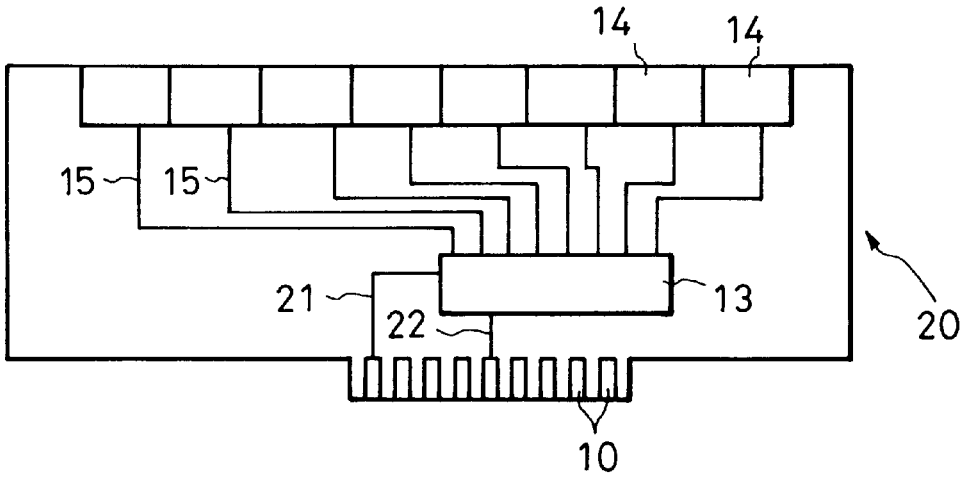
FIG. 8 is a schematic block constructional diagram of the recording head according to the third embodiment of the present invention.

FIG. 8 is a schematic block constructional diagram of the head 20 according to the third embodiment of the present invention. The substrate 14 serving as a recording unit is provided integrally with an electro-thermal converting device, a temperature sensor, and a functional device. The output terminal of the temperature sensor provided to the substrate 14 is extended by means of the wiring 15, the output of which is input into an analog multiplexer 13. Also, the selection signal 21 of the analog multiplexer 13 is supplied from the recording apparatus main unit side via the connector 10. This selection signal 21 allows selection of a temperature sensor in a desired portion to be made from the recording apparatus main unit. Then, the output of the temperature sensor selected by the analog multiplexer 13 serving as the selection means for selecting the output of the temperature sensors is extracted by a connector terminal 10 provided for performing electrical connection with portions other than the head 20.

Now, as described above, with a line head 20 of arrayed elemental substrates 14, each of the elemental substrates 14 are separated thermally, increasing the irregularity in temperature increase between each. Further, in the case of line heads, the change in image duty distribution for each nozzle is small compared to that with serial heads according to the scanning method, thus increasing irregularity in rising of temperature. In such a case, it is effective to increase the number of times of reading the temperature sensors, in order to perform temperature control of the portions with marked rising in temperature with good precision. However, depending on the capabilities of the CPU used or the load of the processing contents, sufficient timing may not be able to be obtained necessary for the number of times of reading the output of the temperature sensors. In such cases, precision of temperature detection can be maintained without lowering the overall processing capabilities, by means of making the number of times that the necessary portions are read to be greater compared to that of the other portions.

According to the present embodiment, precision of temperature detection can be maintained without lowering the overall processing capabilities, by means of the following arrangement: The printing duty is calculated beforehand on the side of the recording apparatus main unit based on the image data, thus predicting the substrate 14 of the block which will take on heavy duty. At the same time, detection temperature reading from a desired substrate 14 is selected, thus increasing the number of times that detection temperature is read in regard to the portion of the substrate 14 which particularly requires temperature detection, as compared with the number of times that detection temperature is read relating other portions.

Further, selecting the temperature sensor to read detection temperature from the main unit according to the operation mode enables selecting of detecting sequences according to the printing mode (various types of printing, etc.), thus allowing temperature detection at even higher precision.

Fourth Embodiment

Figure 9:
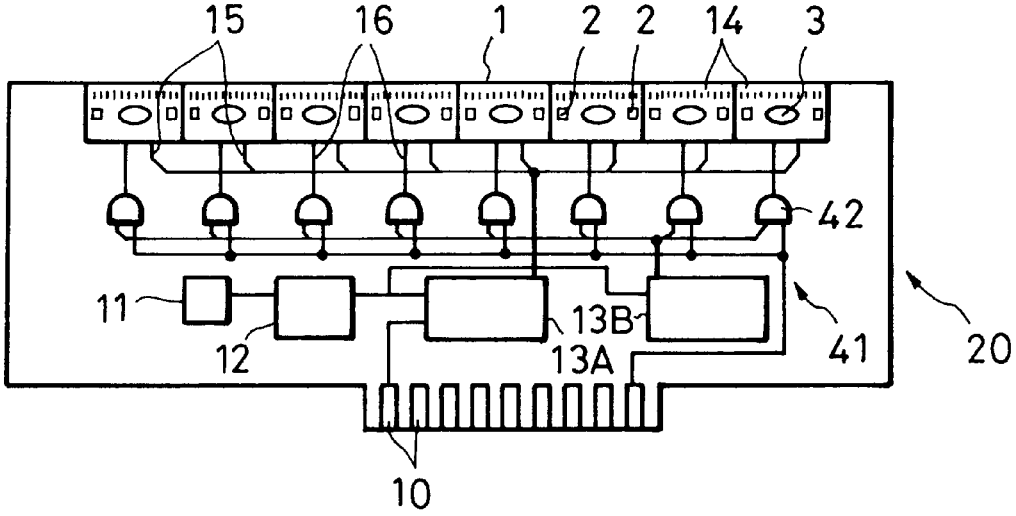
FIG. 9 is a schematic block constructional diagram of the recording head according to the fourth embodiment of the present invention.

FIG. 9 is a schematic block constructional diagram of the head 20 according to the fourth embodiment of the present invention. The substrate 14 serving as a recording unit is provided integrally with an electro-thermal converting device 1, a temperature sensor 2, a functional device, and a temperature-raising heater 3. The output terminal of the temperature sensor provided to the substrate 14 is extended by means of the wiring 15, the output of which is input into an analog multiplexer 13A. A clock signal from an oscillator 11 is input to a counter 12, which is then converted to a binary decode signal and input into an analog multiplexer 13A. The output of the temperature sensor selected by the analog multiplexer 13A serving as temperature sensor output selection means is extracted from the head 20 by means of output terminals 10 provided for comprising electrical connection between the head 20 and portions other than the head 20. The output of the temperature sensor for each of the elemental substrates 14 is extracted in a uniform manner by means of using decode signals from the counter 12, thus enabling temperature control of the head 20 based on an averaged value of the temperature of each of the elemental substrates. 14.

Figure 10:
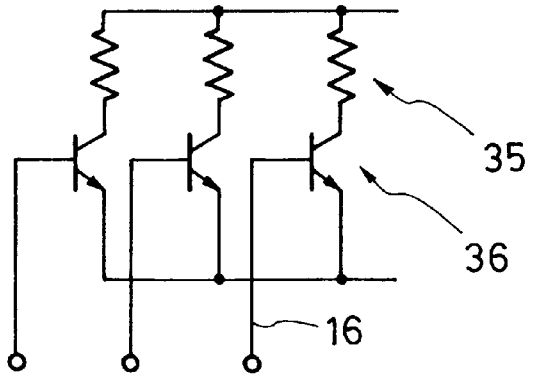
FIG. 10 is a connection circuit diagram of the heaters of the recording head according to the fourth embodiment of the present invention.

FIG. 10 shows a connection example of the heat-retaining heater (temperature adjusting heater) 35 and multiplexer 13B. The heat-retaining heaters 35 provided to each of the elemental substrates 14 are connected to transistors 36 formed on the elemental substrates 14. The selected signal of the heat-retaining heaters 35 is input to the multiplexer 13B, and also a heat-retaining heater driving signal 41 is applied via the terminals 10 from portions other than the head 20 itself, thus driving the heat-retaining heaters as necessary via the wiring 16 according to a logical sum of this signal 41 and the heat-retaining heater selection signal from the multiplexer 13B serving as a selection circuit for selectively driving the temperature adjusting heaters. Reference numeral 42 denotes an AND circuit for logical calculations.

Now, as described above, with a line head 20 of arrayed elemental substrates 14, each of the elemental substrates 14 are separated thermally, increasing the irregularity in temperature increase between each. Further, in the case of line heads, the change in image duty distribution for each nozzle is small compared to that with serial heads according to the scanning method, thus increasing irregularity in rising of temperature. In such a case, it is effective to read all of the temperature sensors, in order to perform temperature control with good precision. According to the present embodiment, the detection temperatures of the temperature sensors of all of the elemental substrates 14 can be read, without increasing the number of connection terminals connecting the head 20 to portions other than the head 20, thus enabling maintaining of necessary temperature detection precision. Further, instead of heating all of the connected heat-retaining heaters at the same time, the driving conditions thereof are selectively changed, thus dealing with irregularities in the temperature distribution of the line head 20, and also aiding in reducing in energy consumption of the head 20.

Fifth Embodiment

Figure 11:
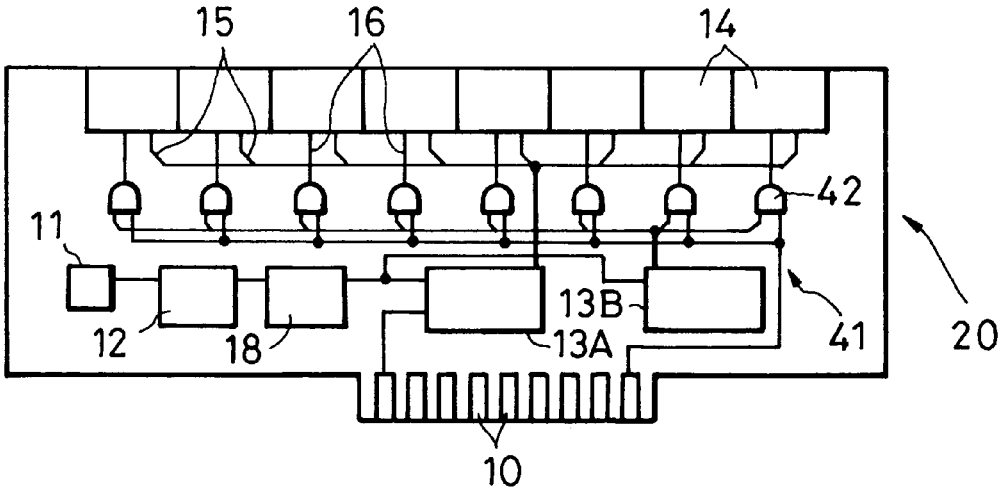
FIG. 11 is a schematic block constructional diagram of the recording head according to the fifth embodiment of the present invention.

FIG. 11 is a schematic block constructional diagram of the head 20 according to the fifth embodiment of the present invention. The substrate 14 serving as a recording unit is provided integrally with an electro-thermal converting device, a temperature sensor, a heat-retaining heater, and a functional device. The output terminal of the temperature sensor provided to the substrate 14 is extended by means of the wiring 15, the output of which is input into an analog multiplexer 13A. A clock signal from an oscillator 11 is input to a counter 12, thus generating an address signals for the memory 18. Selection signals for the analog multiplexers 13A and 13B are set to the memory 18 beforehand, and input is performed to the analog multiplexers 13A and 13B corresponding with the selection signals. The output of the temperature sensor selected by the analog multiplexer 13A serving as temperature sensor output selection means is extracted from the head 20 by means of output terminals 10 provided for comprising electrical connection between the head 20 and portions other than the head 20. The output of the temperature sensor for each of the elemental substrates 14 is extracted in a uniform manner by means of using decode signals from the counter 12, thus enabling temperature control of the head 20 based on an averaged value of the temperature of each of the elemental substrates 14. Further, a selection signal for the heat-retaining heaters (temperature adjusting heater) is input to the analog multiplexer 13B serving as a selection circuit for selectively driving the heat-retaining heaters, from the memory 18, and accordingly, the heat-retaining heater selection signal for selecting the target heat-retaining heater is output. Moreover, a heat-retaining heater driving signal 41 is applied via the terminals 10 from portions other than the head 20 itself, thus driving the heat-retaining heaters as necessary via the wiring 16 according to a logical sum of this signal 41 and the heat-retaining heater selection signal from the multiplexer 13B. Reference numeral 42 denotes an AND circuit for logical calculations.

Now, as described above, with a line head 20 of arrayed elemental substrates 14, each of the elemental substrates 14 are separated thermally, increasing the irregularity in temperature increase between each. Further, in the case of line heads, the change in image duty distribution for each nozzle is small compared to that with serial heads according to the scanning method, thus increasing irregularity in rising of temperature. In such a case, it is effective to increase the number of times of reading the temperature sensors, in order to perform temperature control of the portions with marked rising in temperature with good precision. However, depending on the capabilities of the CPU used or the load of the processing contents, sufficient timing may not be able to be obtained necessary for the number of times of reading the output of the temperature sensors. In such cases, precision of temperature detection can be maintained without lowering the overall processing capabilities, by means of making the number of times that the necessary portions are read to be greater compared to that of the other portions.

According to the present embodiment, as with the description of the aforementioned embodiment, precision of temperature detection can be maintained without lowering the overall processing capabilities, by means of the following arrangement: The printing duty is calculated beforehand on the side of the recording apparatus main unit based on the image data, thus predicting the substrate 14 of the block which will take on heavy duty, and the number of times that detection is made in regard to the temperature sensor of the substrate 14 is increased. Further, instead of heating all of the connected heat-retaining heaters at the same time, the driving conditions thereof are selectively changed, thus dealing with irregularities in the temperature distribution of the line head 20, and also aiding in reducing in energy consumption of the head 20.

Sixth Embodiment

Figure 12:
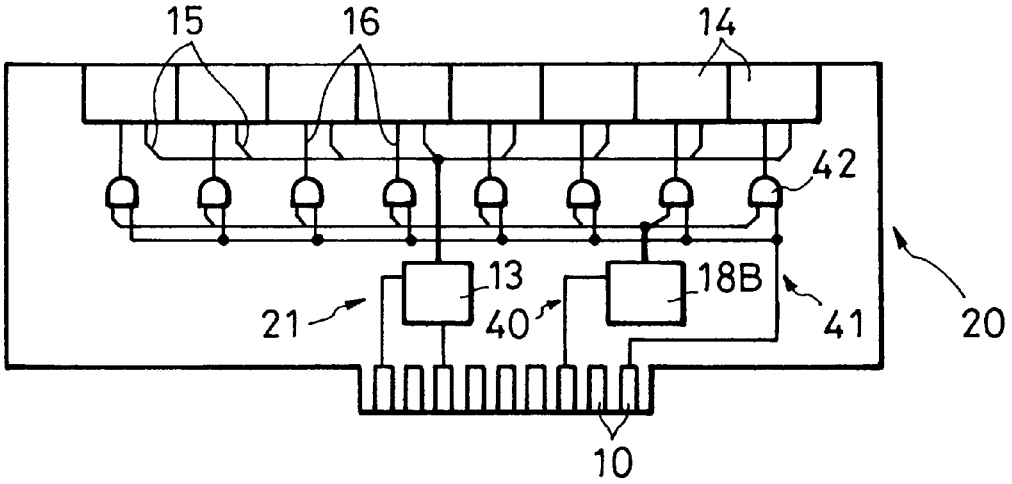
FIG. 12 is a schematic block constructional diagram of the recording head according to the sixth embodiment of the present invention.

FIG. 12 is a schematic block constructional diagram of the head 20 according to the sixth embodiment of the present invention. The substrate 14 serving as a recording unit is provided integrally with an electro-thermal converting device, a temperature sensor, a heat-retaining heater, and a functional device. The output terminal of the temperature sensor provided to the substrate 14 is extended by means of the wiring 15, the output of which is input into an analog multiplexer 13. The analog multiplexer 13 serving as the selection means for selecting the output of the temperature sensors selects a temperature sensor according to the selection signal 21, and the output thereof is extracted by a connector terminal 10 provided for performing electrical connection with portions other than the head 20.

Also, heat-retaining heater selection data is set to the heat selector 18B, and adding a clock signal 40 from a portion other than the head 20 causes an appropriate heat-retaining heater selection signal to be output according to the heat-retaining mode. Also, a heat-retaining heater driving signal 41 is applied from portions other than the head 20 itself, thus driving the heat-retaining heaters as necessary via the wiring 16 according to a logical sum of this signal 41 and the heat-retaining heater selection signal from the heater selector 18B serving as a selection circuit for selectively driving the heat-retaining heaters.

Now, as described above, with a line head 20 of arrayed elemental substrates 14, each of the elemental substrates 14 are separated thermally, increasing the irregularity in temperature increase between each. Further, in the case of line heads, the change in image duty distribution for each nozzle is small compared to that with serial heads according to the scanning method, further increasing the tendency of rising of temperature. In such a case, it is effective to increase the number of times of reading the temperature sensors, in order to perform temperature control of the portions with marked rising in temperature with good precision. However, depending on the capabilities of the CPU used or the load of the processing contents, sufficient timing may not be able to be obtained necessary for the number of times of reading the output of the temperature sensors. In such cases, precision of temperature detection can be maintained without lowering the overall processing capabilities, by means of making the number of times that the necessary portions are read to be greater compared to that of the other portions.

According to the present embodiment, as with the previous embodiments, precision of temperature detection can be maintained without lowering the overall processing capabilities, by means of the following arrangement: The printing duty is calculated beforehand on the side of the recording apparatus main unit based on the image data, thus predicting the substrate 14 of the block which will take on heavy duty, and the number of times that detection is made in regard to the temperature sensor of the substrate 14 is increased. Further, instead of heating all of the connected heat-retaining heaters at the same time, the driving conditions thereof are selectively changed, thus dealing with irregularities in the temperature distribution of the line head 20, and also aiding in reducing in energy consumption of the head 20.

Seventh Embodiment

Figure 13:
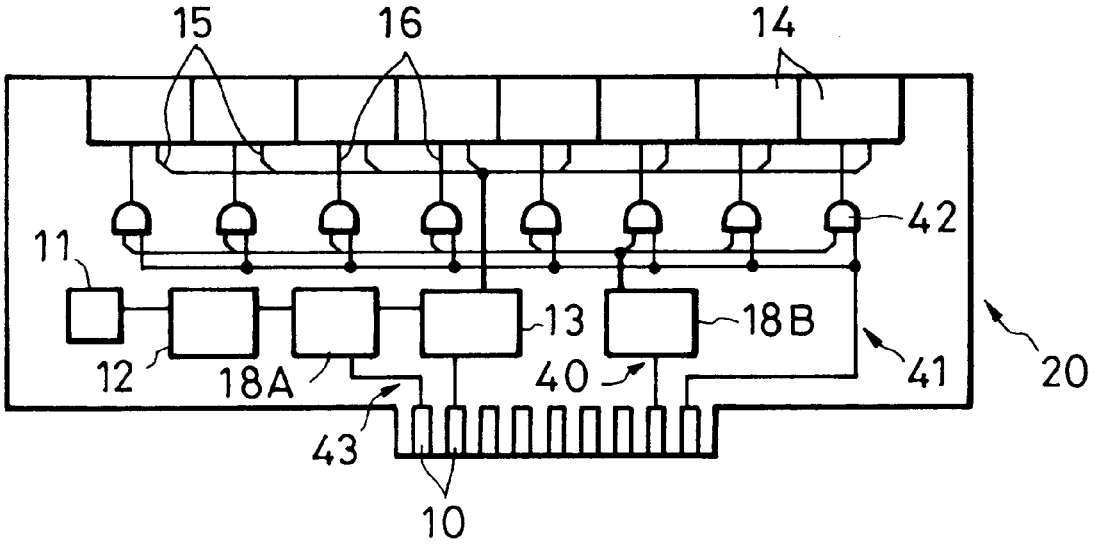
FIG. 13 is a schematic block constructional diagram of the recording head according to the seventh embodiment of the present invention.

FIG. 13 is a schematic block constructional diagram of the head 20 according to the seventh embodiment of the present invention. The substrate 14 serving as a recording unit is provided integrally with an electro-thermal converting device, a temperature sensor, a temperature-retaining heater, and a functional device. The output terminal of the temperature sensor provided to the substrate 14 is extended by means of the wiring 15, the output of which is input into an analog multiplexer 13 serving as the selection means for selecting the output of the temperature sensors. A clock signal from an oscillator 11 is input to a counter 12, thus generating an address signal for the memory 18A. Further, a necessary memory address is generated according to the detection mode, by means of further applying a memory address signal 43 from portions other than the head 20. Selection signals for the analog multiplexer 13 are set to the memory 18A beforehand, and input of the address signal 43 to the memory 18 is performed, thus inputting the selection signal of the memory 18A to the analog multiplexer 13. The output of the temperature sensor selected by the analog multiplexer 13 is extracted from the head 20 by means of output terminals 10 provided for comprising electrical connection between the head 20 and portions other than the head 20.

Now, the weighting data set in the memory 18A is temperature sensor selection data corresponding to temperature sensor reference times (the number of times that reading has been performed for temperature sensor output) according to the temperature properties of each of the elemental substrates 14. The temperature sensor output from the substrate 14 is extracted in a weighted and selected manner, by means of using the selection signal of the memory 18A, so that temperature control of the head 20 can be performed based on each temperature sensor output weighted uniquely according to the head, as necessary.

Also, heat-retaining heater selection data is set to the heat selector 18B serving as a selection circuit for selectively driving temperature adjusting heaters, and adding a clock signal 40 from a portion other than the head 20 causes an appropriate heat-retaining heater selection signal to be output according to the heat-retaining mode. Also, a heat-retaining heater driving signal 41 is applied from portions other than the head 20 itself, thus driving the heat-retaining heaters as necessary via the wiring 16 according to a logical sum of this signal 41 and the heat-retaining heater selection signal from the heater selector 18B. Reference numeral 42 denotes an AND circuit for logical calculations.

Now, as described above, with a line head 20 of arrayed elemental substrates 14, each of the elemental substrates 14 are separated thermally, increasing the irregularity in temperature increase between each. Further, in the case of line heads, the change in image duty distribution for each nozzle is small compared to that with serial heads according to the scanning method, further increasing the tendency of rising of temperature. In such a case, it is effective to increase the number of times of reading the temperature sensors, in order to perform temperature control of the portions with marked rising in temperature with good precision. However, depending on the capabilities of the CPU used or the load of the processing contents, sufficient timing may not be able to be obtained necessary for the number of times of reading the output of the temperature sensors. In such cases, precision of temperature detection can be maintained without lowering the overall processing capabilities, by means of making the number of times that the necessary portions are read to be greater compared to that of the other portions.

According to the present embodiment, as with the previous embodiments, precision of temperature detection can be maintained without lowering the overall processing capabilities, by means of the following arrangement: The printing duty is calculated beforehand on the side of the recording apparatus main unit based on the image data, thus predicting the substrate 14 of the block which will take on heavy duty, and the frequency of times that detection is made in regard to the temperature sensor of the substrate 14 is increased. Further, instead of heating all of the connected heat-retaining heaters at the same time, the driving conditions thereof are selectively changed, thus dealing with irregularities in the temperature distribution of the line head 20, and also aiding in reducing in energy consumption of the head 20.

Further, selectively operating the temperature sensor and heat-retaining heater from the recording apparatus main unit according to the operation mode thereof enables executing detecting and heat-retaining sequences according to the printing mode (various types of printing, etc.), thus allowing temperature control at even higher precision.

Structural example of overall ink-jet recording apparatus

Figure 16:
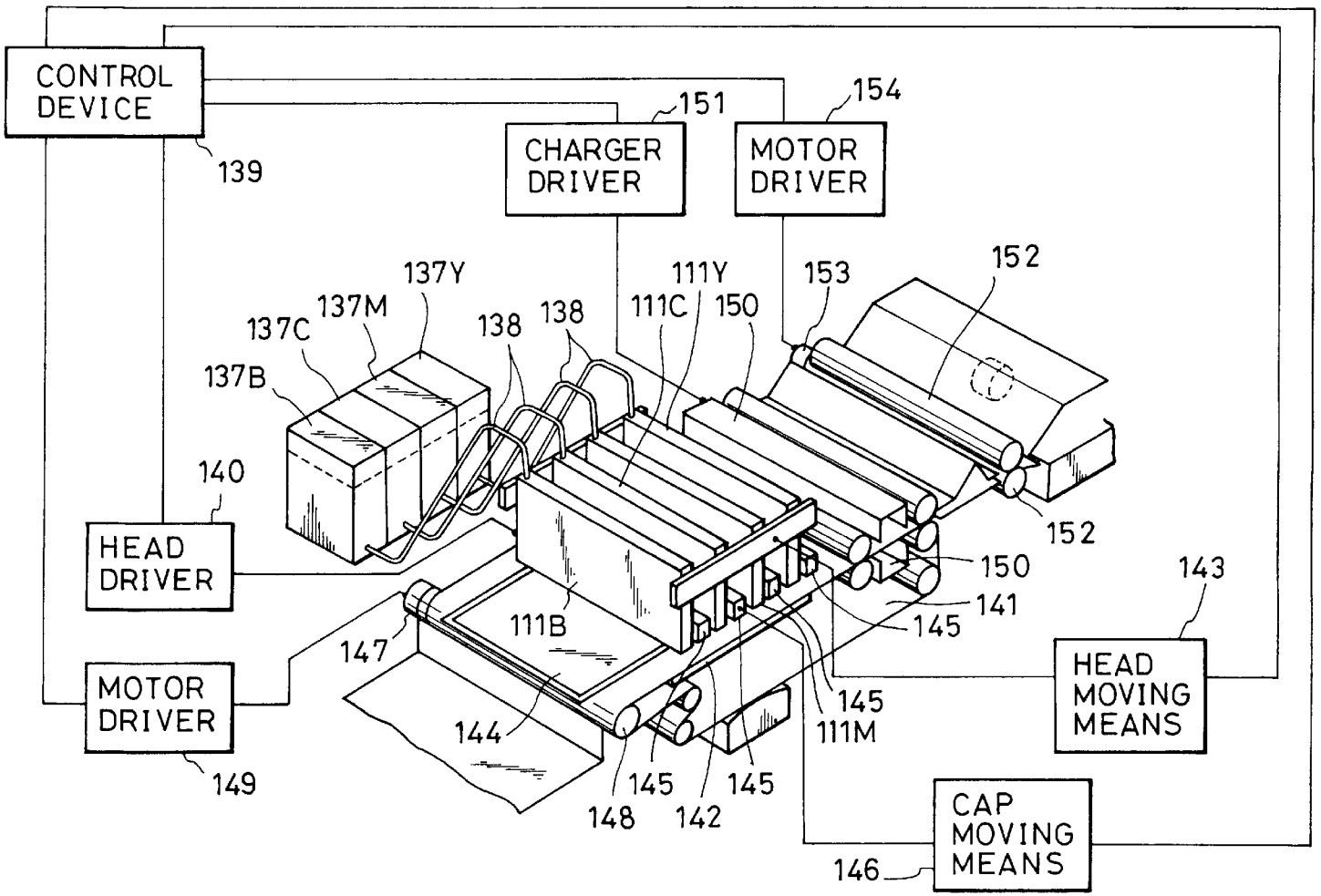
FIG. 16 is a perspective view of the principal components of the recording apparatus according to an embodiment of the present invention.

FIG. 16 illustrates an external view of a structural example of an ink-jet recording apparatus according to the present invention.

The ink-jet recording apparatus according to the present embodiment is a full-line type color printer. The ink-jet cartridge is comprised of: ink tanks storing yellow ink, magenta ink, cyan ink, and black ink, with the ink tanks storing these inks being respectively denoted by 137Y, 137M, 137C, and 137B (these four hereafter referred to collectively as "ink tanks 137"); and ink-jet heads connected to the ink tanks 137 by respective connecting tubes 138, with these four ink-jet heads being respectively denoted by 111Y, 111M, 111C, and 111B (these four hereafter referred to collectively as "ink heads 111"); wherein each of the ink tanks 137 are replaceable with respect to the connecting tubes 138.

Electricity is turned on and off to each of the heat-generating resistors 16 serving as electro-thermal converting devices in the ink-jet heads 111, by means of the head driver 40 connected to the control device 139. The ink heads 111 are arrayed with certain spacing in the direction of transporting of an endless transporting belt 141, so as to face a platen 142 across from the transporting belt 141. The ink heads 111 are arranged so as to be capable of rising in the direction opposing the platen 142, by means of head movement means 143 for recovery processing of which the operation is controlled by the control device 139. Head caps 145 are arrayed to the side of each of the ink-jet heads 111, so as to be offset half-pitch to the arraying spacing of the ink-jet heads 111, these head caps being provided for performing recovery processing of the ink-jet heads 111 before performing recording onto the recording paper 144, wherein the old ink present in the ink channels 129 is discharged from the ink discharging orifices 124. Each of the head caps 145 move to a position directly below the corresponding ink-jet heads 111 by means of cap movement means 146 controlled by the control device 139, to receive waste ink discharged from the ink discharging orifices 124.

The transporting belt 141 which transports the recording paper 144 is wound onto a driving roller 148 linked with a belt driving motor 147, the motor 147 being controlled by a motor driver 149 which is connected to the control device 139. A charging device 150 for causing the recording paper 144 to stick to the transporting belt 141 by means of charging the transporting belt 141 is provided upstream on the transporting belt 141, this charging device 150 being controlled by means of a charging device driver 151 which is connected to the control device 139. A pair of paper feeding rollers 152 for feeding recording paper 144 are provided on the transporting belt 141, being linked to a paper feeding motor 153 for driving the pair of paper feeding rollers 152, which feeding motor 153 is controlled by a motor driver 154 which is connected to the control device 139.

Recording on the recording paper 144 is performed as follows: First, the ink-jets 111 rise so as to be distanced from the platen 142, then the head caps 145 move to a position directly below the ink-jet heads 111 to perform recovery processing, following which the head caps 145 move to the original stand-by position, and the ink-jets move to the printing position to the side of the platen 142. Then, the charging device 150 is operated at the same time as the transporting belt 141 is being driven, and further, recording paper 144 is loaded on the transporting belt 141 by means of the paper feeding rollers 152, after which the certain color image is recorded onto the recording paper 144 by means of each of the recording heads 111.

Other Embodiments

While the present invention can be applied to ink-jet recording methods which use piezo-electric devices as the recording devices, the present invention exhibits excellent effectiveness regarding recording heads and recording apparatuses which are provided with means for generating thermal energy to be used for discharging ink and employ a method wherein a change in state of the ink is generated by means of the aforementioned thermal energy. This is due to the fact that according to such a method, there is great irregularity in the temperature between each of the recording units owing to the heat generated by the electro-thermal converting devices used as recording devices.

Regarding representative constructions and principles thereof, it is preferable to follow the basic principles disclosed in U.S. Pat. No. 4,723,129 and U.S. Pat. No. 4,740,796, for example. This method is applicable to either the so-called on-demand type or continuous type, but is particularly effective with the on-demand type. That is because the on-demand type involves the following operation: Liquid (ink) is held in sheets or liquid channels, and electro-thermal converters are arranged corresponding to the sheets or liquid channels. The electro-thermal converters are applied with at least one drive signal which provides a rapid temperature rise exceeding the boiling point of the ink in response to recording information, thus generating thermal energy in the electro-thermal converter, causing film boiling at the thermal acting surface of the recording head, consequently allowing formation of bubbles within the liquid (ink) in a manner corresponding with the drive signals one-on-one. The liquid (ink) is discharged from the discharging orifice by means of the growth and shrinking of the bubble, thus forming at least one droplet. Growth and shrinking of the bubble occurs in an instantaneous and appropriate manner by means of making the drive signal to be a pulse, and thus is preferable since it allows for achievement of discharge of liquid (ink) in a manner particularly excellent regarding responsivity. Preferable examples of the pulse-formed drive signal are disclosed in U.S. Pat. No. 4,463,359 and U.S. Pat. No. 4,345,262. Even more excellent recording can be performed by employing the conditions regarding the rate of temperature increase of the aforementioned thermal acting surface disclosed in U.S. Pat. No. 4,313,124.

In addition to combinations of the discharge orifices, liquid channels, and electro-thermal converters (straight liquid channels or right-angle liquid channels) disclosed in the aforementioned Patent Specifications, the construction of the recording head includes such as disclosed in U.S. Pat. No. 4,558,333 and U.S. Pat. No. 4,459,600, disclosing an arrangement wherein the heat-generating portion is situated in the bent region. i.e., regardless of the form of the recording head, recording can be performed in a sure and effective manner according to the present invention.

In addition, the present invention is also effective in cases of the aforementioned serial-type recording apparatuses, using recording heads fixed to the apparatus main unit, chip-type replaceable recording heads which are mounted to the apparatus main unit and are supplied with electric connections and ink by being connected to the apparatus main unit, or cartridge-type recording heads wherein the ink tank is provided integrally with the recording head.

Also, regarding the construction of the recording apparatus according to the present invention, addition of discharge recovery means for the recovery head and preliminary auxiliary means is preferable, as it further enhances the effects of the present invention. Specific examples of such include: capping means for capping the recording head, cleaning means, pressure or suction means, pre-heating means for performing heating using electro-thermal converters or other heating devices or a combination thereof, and pre-discharge means for performing discharge other than that performed upon conducting recording.

Also, regarding the type or number of the recording heads mounted, the arrangement may include a single head corresponding to a single color, or a plurality of heads provided corresponding to a plurality of inks with different recording colors or hues. i.e., while the arrangement may involve not only a recording mode of a main color such as black for the recording mode of the recording apparatus, for example, but may include a head integrally formed of a combination of a plurality of heads, the present invention is extremely effective regarding apparatuses comprising at least one of the following recording modes: compound color using different colors, or full color recording using mixed color.

Furthermore, although the above-described embodiments according to the present invention have been described using ink as a liquid, the ink may be such which softens or liquefies at room temperature, or such which liquefies upon application of the recording signals, since it is a common procedure in ink-jet recording to perform temperature adjustment of the ink within a range of 30° C. to 70° C. so as to control the viscosity of the ink to be within a stable discharge range. Moreover, ink may be used which is solid in a resting state and liquefies under heat, in order to aggressively prevent rising of temperature due to thermal energy by using the thermal energy for causing the change in state of the ink from solid to liquid, and also to prevent evaporation of ink. In any case, the present invention is applicable to arrangements wherein ink liquefies due to application of thermal energy in response to recording signals, or arrangements wherein the ink has already begun to solidify by the time of reaching the recording medium, i.e., arrangements wherein the ink used is such that only application of thermal energy causes liquefaction thereof.

Moreover yet, the recording apparatus according to the present invention may be such which is used as an image output terminal of information processing equipment such as a computer or the like, or a photocopying device which is combines with a reader or the like, or even such in the form or a facsimile device which has sending and receiving communication functions.

As described above, according to the present invention, the detection signals of temperature sensors provided to a plurality of elemental substrates can be selectively output from a shared terminal, enabling detection of the temperature of all of the elemental substrates without increasing the number of terminals, thus allowing fine temperature control of the elemental substrates.

Also, even finer temperature control of the elemental substrates can be performed by means of selectively driving the heaters provided to the plurality of elemental substrates, thus enabling achieving higher image quality, prevention of density irregularities, and improvement of operation reliability.

What is claimed is:

1. A recording head for performing recording on a recording medium, said recording head comprising:

a plurality of recording units each further comprising a recording device for performing recording on a recording medium and a temperature detecting sensor;

a base supporting said plurality of recording units, said recording units being disposed upon said base so as to form said recording head; and a selection circuit for selectively outputting from the head to portions other than the head a detection signal from each of said sensors of each of said recording units for detecting a variation of temperature in the head.

2. A recording head according to claim 1, wherein said selection circuit further comprises weighting means for weighting the detection value of each sensor according to the frequency of selection of each sensor for the selective output of the detection signals of said sensors.

3. A recording head according to claim 1, wherein said selection circuit further comprises a circuit for selectively outputting detection signals of said plurality of sensors, based on external selection signals.

4. A recording head according to any of the claims 1 through 3, wherein said selection circuit further comprises a multiplexer.

5. A recording head according to claim 1, wherein each of said recording units is provided with a temperature adjusting heater.

6. A recording head according to claim 5, further comprising a selection circuit for selectively driving said temperature adjusting heaters provided to each of said plurality of recording units.

7. A recording head according to claim 1, wherein said recording unit is constructed as a substrate with said recording device and temperature detecting sensor being built in integrally.

8. A recording head according to claim 7, wherein a plurality of said elemental substrates are arrayed in a row so as to form a lengthy arrangement.

9. A recording head according to claim 5, wherein said recording unit is constructed as a substrate with said recording device, temperature detecting sensor, and temperature adjusting heater being built in integrally.

10. A recording head according to claim 9, wherein a plurality of said elemental substrates are arrayed in a row so as to form a lengthy arrangement.

11. A recording head according to either of claim 1 or claim 6, wherein said recording device is an electro-thermal conversion device which performs recording by generating heat.

12. A recording head according to either of claim 7 or claim 9, wherein said recording device is an electro-thermal conversion device which causes formation of bubbles within the ink by means of the heat generated, and causes the ink to be ejected by means of the pressure generated at the time of said bubble generation.

13. A recording head for performing recording on a recording medium, said recording head comprising:

a plurality of recording units each further comprising a recording device for performing recording on a recording medium and a temperature adjusting heater;

a base supporting said plurality of recording units, said recording units being disposed upon said base so as to form said recording head; and a selection circuit for selectively driving said temperature adjusting heaters of said plurality of recording units in order to reduce a variation in a temperature of the head.

14. A recording head according to claim 13, wherein said selection circuit further comprises weighting means for weighting each of said plurality of heaters according to the frequency of selection of each plurality of recording devices during selective driving of said recording devices.

15. A recording head according to claim 13, wherein said selection circuit further comprises a circuit for selectively driving said plurality of heaters, based on external selection signals.

16. A recording head according to any of the claims 13 through 15, wherein said selection circuit further comprises a multiplexer.

17. A recording head according to claim 13, wherein said recording unit is constructed as a substrate with said recording device, temperature detecting sensor, and temperature adjusting heater being built in integrally.

18. A recording head according to claim 17, wherein a plurality of said elemental substrates are arrayed in a row so as to form a lengthy arrangement.

19. A recording head according to claim 13, wherein said recording device is an electro-thermal conversion device which generates thermal energy for discharging ink.

20. A recording apparatus for performing recording on a recording medium, said recording apparatus comprising:

a recording head according to either of claim 1 or claim 13; and transporting means for transporting recording medium.

* * * * *